US006625944B2

(12) United States Patent
Mackay

(10) Patent No.: US 6,625,944 B2
(45) Date of Patent: Sep. 30, 2003

(54) RIGHT ANGLE CONNECTOR FOR FRAMING MEMBERS

(76) Inventor: Iain N. B. Mackay, R.R. #2, Beeton, Ontario (CA), L0G 1A0

( * ) Notice: Subject to any disclaimer, the term of this patent is extended or adjusted under 35 U.S.C. 154(b) by 22 days.

(21) Appl. No.: 09/984,102

(22) Filed: Oct. 29, 2001

(65) Prior Publication Data

US 2003/0079427 A1 May 1, 2003

(51) Int. Cl.[7] ..... E04B 1/00; E04B 5/00

(52) U.S. Cl. ..... 52/261; 52/270; 52/272; 52/275

(58) Field of Search ..... 52/261, 262, 263, 52/264, 265, 266, 267, 268, 269, 270, 271, 272, 274, 275, 279

(56) References Cited

U.S. PATENT DOCUMENTS 683,442 A * 10/1901 Cooley ..... 52/270
975,692 A * 11/1910 Jeffers ..... 138/157
1,945,784 A 2/1934 Myer
2,104,876 A 1/1938 Wetherbee
2,116,426 A 5/1938 Cecil
2,826,791 A * 3/1958 Clement ..... 403/231
3,935,671 A 2/1976 Soot
4,484,427 A * 11/1984 Crites et al. ..... 52/261
4,508,319 A 4/1985 Tappan et al.
4,587,783 A * 5/1986 McCoy et al. ..... 52/282.3
5,177,899 A 1/1993 Powell
5,291,708 A 3/1994 Johnson
5,619,829 A 4/1997 Tan et al.
5,826,372 A 10/1998 Parsons
5,852,895 A 12/1998 Sinanan

* cited by examiner

*Primary Examiner*—Jeanette Chapman
(74) *Attorney, Agent, or Firm*—Trevor C. Klotz

(57) ABSTRACT

A connector for joining two elongate framing members in abutting right angle relationship to form either a right angle corner connection or T-connection between the framing members is disclosed. The connector can optionally include panel receiving means to receivingly support two rectangular panel sections in complimentary right angle relationship above or below the joined together framing members. Connectors which include the panel receiving means are useful in constructing containers such as planters or the like and which have upper and lower rectangular frames with the rectangular panel sections disposed therebetween and thus forming the sidewalls for the container.

17 Claims, 4 Drawing Sheets

RIGHT ANGLE CONNECTOR FOR FRAMING MEMBERS

FIELD OF INVENTION

This invention relates to a novel connector useful in joining in abutting right angle relationship two elongate framing members where either a right angle corner connection or T-connection between the framing members is required. The connector of this invention can also include panel receiving means, so that in addition to providing a right angle connection for framing members, the same connector can also receivingly support two rectangular panel sections in complimentary right angle relationship above or below the joined together framing members.

BACKGROUND OF THE INVENTION

It is well recognized that unskilled handymen have difficulty in joining together framing members in a positive right angle relationship where the framing members are made up of lumber having the same cross-sectional dimensions. This is particularly so where the minimum thickness sections of the lumber are to be abuttingly joined together as is, for example, commonly the case when butt joining sections of 2"×4" lumber together to produce an open frame wherein the frame members display a width of 4". Rectangular frames displaying the maximum width of interconnected lumber are commonly employed in the construction of the various walls of a box or for supporting the bottom and/or the top of a box. Where 2"×4" lumber is joined together to form an open rectangular frame to support the bottom or top sidewalls of a box, known right angle corner or T-shaped frame connectors, at least hitherto, have not also been capable of supporting in right angle relationship vertical sidewall or panel sections at the point where they overlie the right angle connector which holds the two framing members together in right angle abutting relationship.

SUMMARY OF THE INVENTION

In its broadest respect, the connector of this invention is useful in joining together in right angle abutting relationship two elongate framing members that have the same rectangular cross-sectional dimensions, such as 2"×4" lumber. While the connector can be constructed from any suitable material such as plastic or metal, metal is preferred given its inherent strength and ease of fabrication and the fact that it can be produced from a single metal stamping. In this latter respect, and in accordance with one aspect of this invention the right angle connector which can be used as a corner or a T-connector comprises an elongate rectangular section having opposite major faces, opposite ends and opposite sides. An end flange projects downwardly from one of the major faces at one of the ends and opposed side flanges project downwardly from the same major face at each of the sides. The side flanges themselves are spaced apart one from another and from the end flange at a predetermined distance which corresponds to a cross-sectional length of the framing members and which length, preferably is the longest cross-sectional length of the framing members.

The connector also includes means for fastening the connector to the two framing members when the end portion of one framing member is located in the spacing between the side flanges and when the other framing member is located in the spacing between the end flange and the two side flanges. Where the framing members are wooden members, the means for fastening the connector to the wood framing members preferably includes a plurality of fastener receiving holes for nails or screws, which can be located in the elongate rectangular section and one or more of the end flange and side flanges.

In situations where one desires to construct an open rectangular box having vertical sidewalls, right angle corner connectors of the foregoing description, in accordance with a further embodiment of this invention can advantageously include panel receiving means which each project upwardly from the major face of the rectangular section opposite from the major face from which the end flange and side flanges. The panel receiving means are arranged at right angles one to the other so to respectively receive in right angle relationship portions of two rectangular wall or panel sections when positioned therein. It will thus be appreciated that if two identically dimensioned rectangular frames are made utilizing this type of corner and sidewall connector, one frame with the panel receiving means projecting upwardly can be used to receivingly support from the bottom two rectangular sidewall or panel sections in right angle relationship. The second frame, with its panel receiving means at the corners projecting downwardly, support from the top rectangular sidewall panel sections in a complimentary right angle relationship to the second frame.

Advantageously, each of the two panel receiving means when included with the above described connector comprises a pair of opposed and spaced apart panel receiving flanges having a spacing therebetween which is no less than the thickness of the rectangular panel section which it is intended to support. If desired, the panel receiving means can each be made up from a U-shaped channel section which is attached in a known manner to the upper major face of the elongate rectangular section.

In situations where the connector as above described is intended to serve the two-fold function of joining two framing members in right angle abutting relationship and also supporting thereabove or therebelow two rectangular panel sections in complimentary right angle relationship, the width of the frame need not be the same as the thickness of the rectangular panel and indeed, the materials used in the frame construction and the panel sections can be of different material and of a type not readily joined together.

For example, if the subject connector having the capability of also supporting panel sections is to be used in the construction of an open box, such as a planter for shrubs, flowers or the like, the framing members can be constructed from wood and the panel or sidewall sections from patio stones. Thus, the two panel receiving means on the connectors which each comprise a pair of opposed and spaced apart panel receiving flanges can be either spaced apart a sufficient distance in order to cause a friction fit with a corner of the rectangular panel when inserted therein or alternatively, over dimensioned with provision being made in at least one of the flanges in the pair of flanges for grasping means which is designed to grasp a corner portion of the inserted rectangular panel section and which, for example, may take the form of a U-shaped rubber insert or a pressure bolt which extends through the side of a flange.

In accordance with yet another aspect of my invention, the connector used in corner connecting two elongate framing sections having the same cross-sectional dimensions in right angle abutting relationship can comprise first and second connector members with each connector member having a plate body with opposed major faces and two side edges disposed in right angle relationship. The side edges each include a sidewall which projects outwardly from and in right angle relationship to one of the major faces. Attachment means is provided for interconnecting one major face of the first connector member to the other major face of the second connector member to thereby form between the sidewalls of the two connector members a right angle opening or channel for receiving the two elongate framing members. Apertures are provided in the first and second connector members to thereby facilitate attachment of these members, such as by nailing or screwing, to the framing sections when they are located in right angle abutting relationship within the channel.

Preferably, the attachment means for joining the two members together includes projecting means such as a threaded member which projects vertically upward from said one major face of the first connector member, and an elongate slot extending through the plate body of the second connector member and through which the threaded member extends. This permits opposing sidewalls of the first and second members to move towards and away from one another and so as to accommodate therein framing members having different cross-sectional dimensions. Locking means co-operative with the projecting means for holding the two member together in fixed relationship.

In accordance with another aspect of my invention, the above-described corner connector made up from first and second connector members can itself be utilized as the panel receiving means in place of the previously described U-shaped channel sections. In this latter regard, the two part corner connector is used as the panel receiving means and is positioned on top of the exterior major face of the elongate rectangular section as described in my first connector embodiment. Fastener means, such as nails or screws, join the two part connector, now functioning as the panel receiving means by being driven directly through both corner connectors and into the framing members. An added feature in using the two part corner connector as the panel receiving means is the fact that the sidewalls which now serve to support abutting panel sections in right angle relationship, can be moved towards or away from one another in order to adjust for the thickness of the panel sections disposed therein.

DETAILED DESCRIPTION OF THE DRAWINGS

Figure 1:
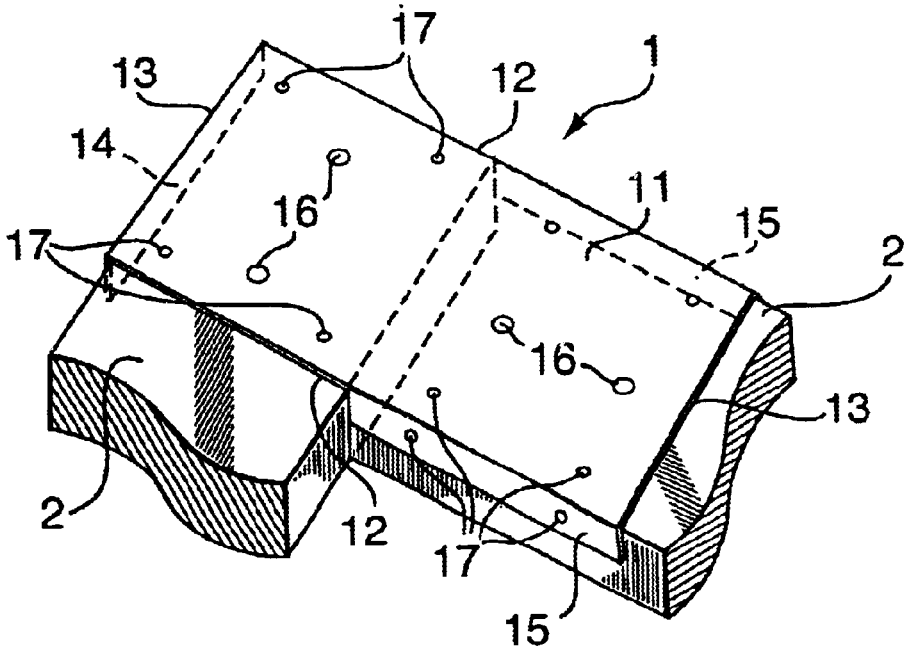
FIG. 1 is a top isometric view of the right angle connecter holding two framing members in abutting right angle relationship, and which can be used as either a corner connector or a T-connector.

With reference to FIG. 1, the right angle connector 1 as illustrated is shown joining two elongate framing members 2 in right angle abutting corner relationship although it will be recognized that connector 1 of this embodiment of the invention can also be used for joining the same framing members together in T-shaped abutting relationship (not shown). Connector 1 consists of elongate rectangular section 11 having opposite sides 12 and opposite ends 13. As illustrated, end flange 14 projects downwardly from section 11 as do side flanges 15. The distance between side flanges 15 and the innermost ends of side flanges 15 and end wall 14 is the same, and corresponds to a cross-sectional length of like framing members 2.

Apertures 17 located in the rectangular section 11, side flanges 15 and end wall 14 permit nails or screws (not shown) to be driven therethrough to positively attach connector 1 to framing members 2 when located therein in right angle abutting relationship as seen in FIG. 1. Apertures 16 provided in rectangular section 11 serve the same purpose and also serve to additionally connect separate panel receiving means as discussed below and if they are to be used with connector 1.

Figure 2:
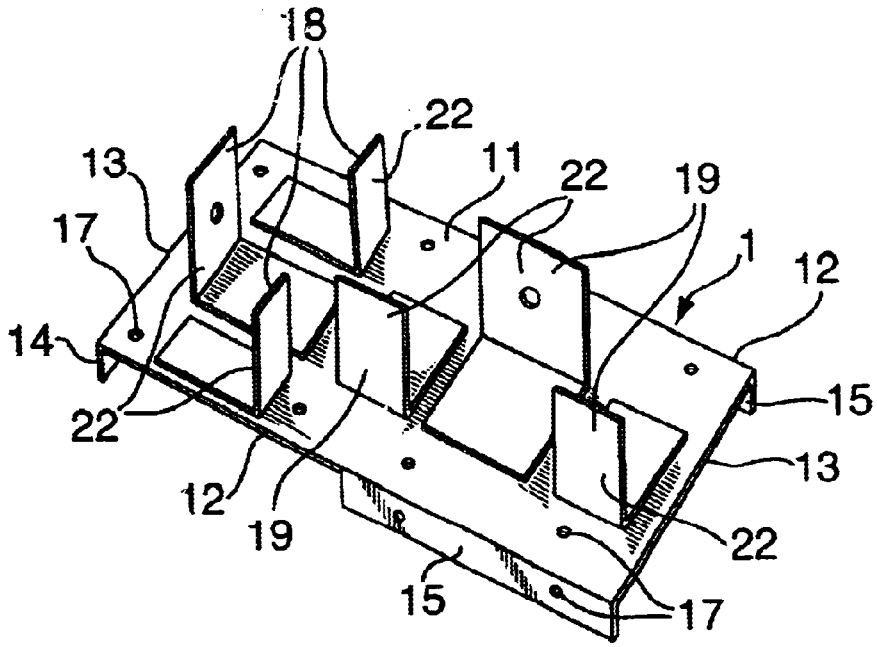
FIG. 2 is a similar view of the connector seen in FIG. 1, but which includes panel receiving means formed from a number of flanges which have been punched and bent upwardly through the major rectangular section of the connector.
Figure 3:
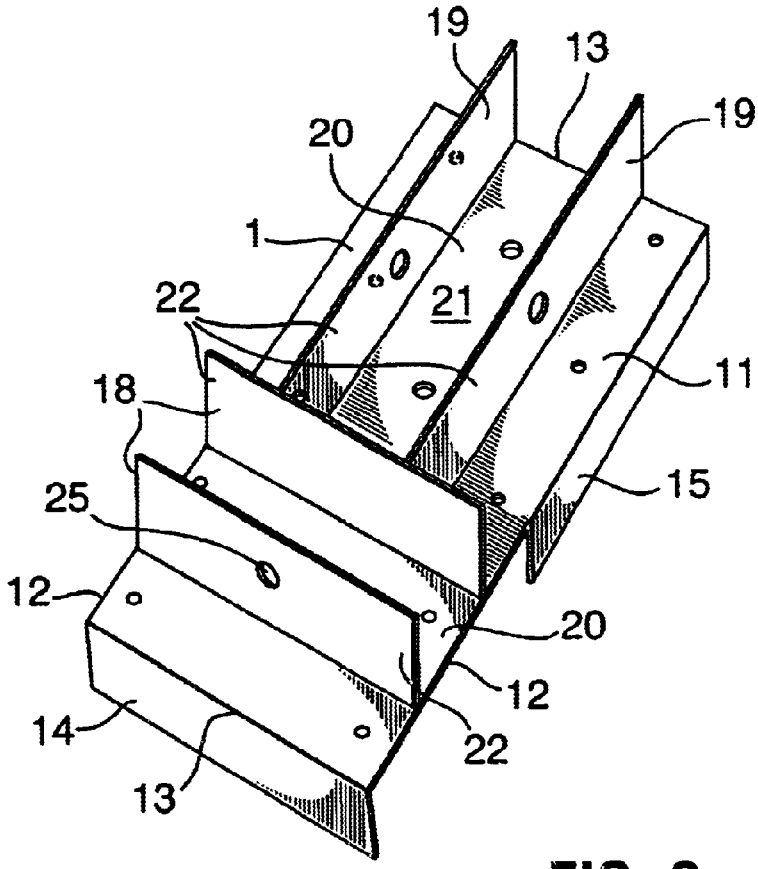
FIG. 3 is another top isometric view of the connector seen in FIG. 1 and which additionally includes panel receiving means on its uppermost surface.
Figure 8:
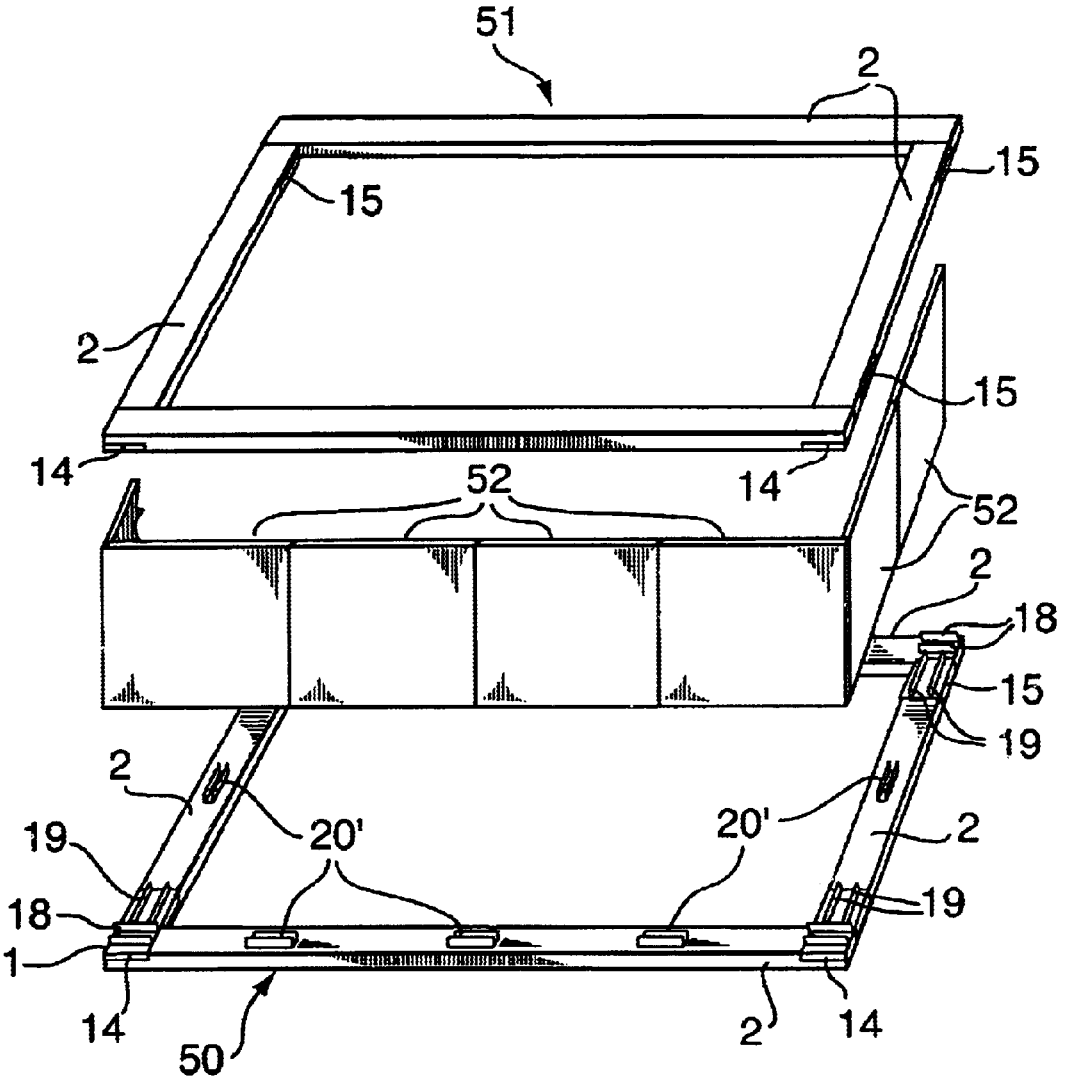
FIG. 8 is an exploded view of upper and lower rectangular frames which have been joined together at their corners with the corner connector seen in FIG. 3 that also includes the panel receiving means for supporting in corresponding right angle relationship panel sections when disposed therein.

With reference to FIGS. 2 and 3, the connector 1 can advantageously include or be combined with two panel or sidewall receiving means 18 and 19 which are arranged at right angle relationship one to the other for respectively receiving corner portions of two rectangular panel sections or sidewalls when positioned therein and as seen in FIG. 8.

Figure 4:
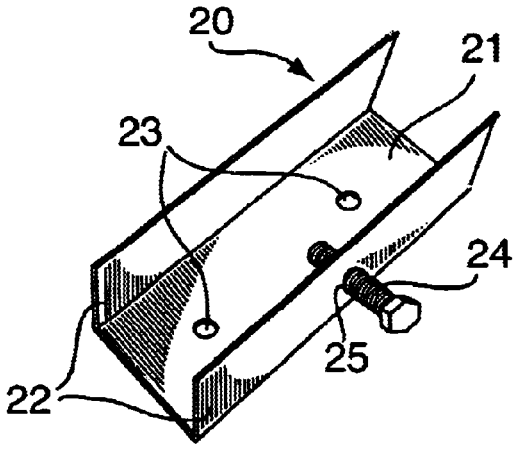
FIG. 4 schematically illustrates one of the panel receiving means and also illustrates means for grasping a panel when positioned therein.

The panel receiving means 18 and 19 illustrated in FIGS. 3 and 4 each consist of separately constructed U-shaped channel sections 20 provided with panel bottom 21 and panel receiving sidewalls 22. In the FIG. 2 embodiment, the panel receiving sidewalls 22 are integral with the connector 1; having been formed by punching through elongate rectangular section 11 and bent upwards as illustrated.

The U-shaped channel connectors as seen in FIGS. 3 and 4 include apertures 23 in bottom 21 which coincide with and overly aperatures 16 seen in FIG. 1 in rectangular section 11. In this arrangement, and where panel or sidewall receiving means 18 and 19 are employed in the manner illustrated in FIG. 3, attachment nails or screws (not shown) can be driven through apertures 23 and the underlying and correspondingly positioned aperatures 16 in connector 1 in order to positively affix both to the underlying framing members 2.

Grasping means in the form of threaded bolt 24 as best seen in FIG. 4 can extend through a threaded aperture 25 in a sidewall flange 22 for the purpose of pressure grasping in a known manner a portion of a panel section (not shown), when located therein.

Figure 5:
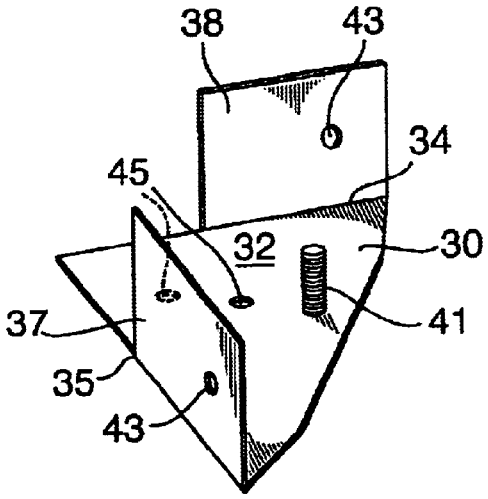
FIGS. 5 and 6 are three dimensional illustrations of the two part right angle corner connector of my invention.
Figure 6:
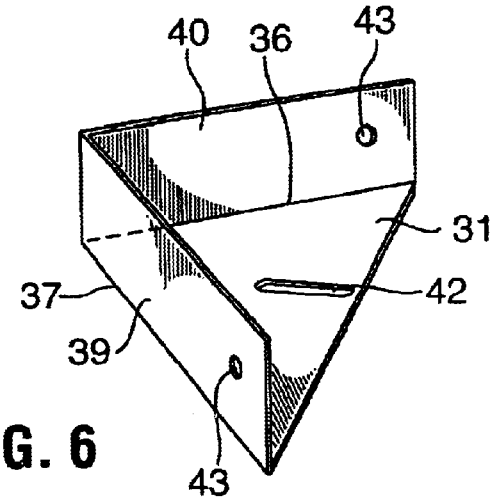
Figure 7:
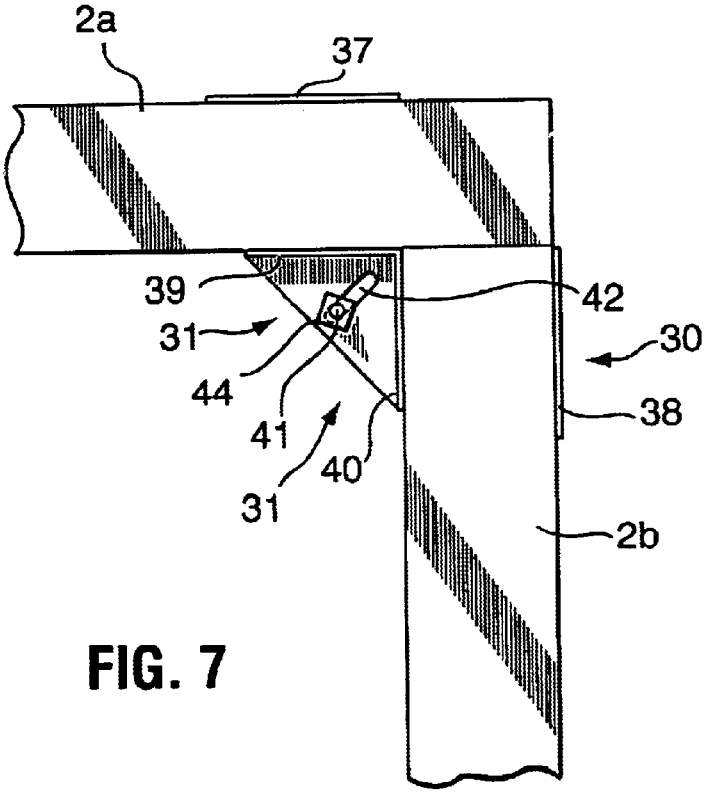
FIG. 7 is a top plan view of the two part connectors of FIGS. 5 and 6 when supporting two framing members in abutting right angle relationship.

Referring now to FIGS. 5, 6 and 7, and as indicated previously, in this particular embodiment of my invention, the right angle corner connector for joining together in abutting relationship two elongate framing sections 2 having the same cross-sectional dimensions can, if desired, optionally be used in the place of panel receiving means 18 and 19 illustrated in FIGS. 2, 3 and 4, by being attached to the top of elongate rectangular section 11 seen in FIG. 1.

The corner connector or panel receiving means illustrated in FIGS. 5 and 6 comprises first and second connector members 30 and 31 each respectively having plate bodies 32 and 33, two side edges 34, 35 and 36, 37 disposed in right angle relationship and which side edges each include sidewalls 37, 38 and 39, 40 which project outwardly from and in right angle relationship to one face of the plate bodies 32 and 33 as illustrated. Attachment means for interconnecting connector members 30 and 31, as illustrated, comprise threaded projection member 41 on member 30 and elongate slot 42 which when in position, is captured by both threaded projection member 41 when member 31 overlies member 30. Sidewall aperatures 43 are common to both members and through which nails or screws may be driven (not shown) when interconnecting two framing members together in right angle corner relationship as seen in FIG. 7. As also seen in FIG. 7, when the framing members 2 are located in position, second connector member 31 is moved inwardly against the framing members and locked in position by tightening nut 44 attached to threaded projection member 41.

Aperatures 45 can also be provided in plate body 32 of first connector member 30 as seen in FIG. 5. Advantageously, the location of aperatures 45 can coincide with aperature 16 in the connector seen in connector 1 with reference to FIG. 1 so that member 30 can be physically attached to member 1 in overlying right angle relationship by driving nails or screws therethrough and into the underlying framing member 2.

With reference to FIG. 7, while the connector members 30 and 31 therein illustrated are shown holding framing members 2 in right angle relationship, it will be appreciated that if members 30 and 31 are used as a panel receiving means by being attached to the connector illustrated in FIG. 1, connectors 30 and 31 could then be used to support rectangular panel sections having the same thickness, such as plywood panels or patio tiles in right angle abutting relationship in the place and stead of framing members 2.

It will be observed that sidewalls 37 and 38 of connector member 30 seen in FIGS. 5 and 7, while in right angle relationship, do not abut one another, although, if desired they could (not shown), but would necessarily limit its utility to that of a right angle corner connector. The space between sidewalls 37 and 38 as seen in these Figures permits the connector to function as a right angle corner connector as illustrated in FIG. 7 or as a right angle T connector whereby upper framing member 2 seen in FIG. 7 could extend fully across and be located on either side of lower framing member 2*b*.

The planter box illustrated in exploded view in FIG. 8 is made up from identically assembled lower and upper rectangular open rectangular frames 50 and 51 wherein the four elongate framing members 2 in each rectangular open frame 50, 51 are attached at their corners utilizing for that purpose the corner connector 1 and accompanying panel receiving means as best illustrated in FIG. 3.

Upper rectangular frame 51 is inverted so that its panel or sidewall receiving means 18 and 19 located at each corner extend downwardly whereas the same receiving means on each corner of lower rectangular frame 50 project upwardly.

The panel receiving means 18 and 19 used in the connector construction of FIG. 3 includes separately constructed U-shaped channel sections 20 as discussed in connection with FIGS. 3 and 4. Stand alone channel sections, identified in FIGS. 8 as 20' and which are identical to channel sections 20, are strategically attached in spaced apart relationship along the opposed faces of framing members 2 of lower rectangular frame 50 and on the underside surface or face of upper rectangular frame 51. Rectangular panels, such as rectangular plywood or patio tiles 52 of any desired dimension and thickness are strategically positioned in the panel receiving means 18 and 19 located at the corners of lower rectangular frame 50 so that, at the corners, two panels 52 are supported in vertical right angle relationship. Aligned and adjacent panels 52 are similarly supported vertically by U-shaped channel sections 20'. Because upper rectangular frame 51 is identical to lower frame 50, but inverted, the upper right angled corner portions of panels 52 in right angle relationship and those panels 52 which are aligned, are supported from the top in a like manner.

One significant advantage of the right angle connector seen in FIG. 1, the right angle connector seen in FIGS. 5 and 6, and the FIG. 1 connector in combination with panel receiving means as illustrated in FIGS. 2 and 3 or in FIGS. 5 and 6 is that they are all universal connectors in the sense a left or right hand connector is not required in assembling the framework, and this is also true with respect to any accompanying panel receiving means.

I claim:

1. A connector for joining together two elongate framing members that have the same rectangular cross-sectional dimensions in either abutting right angle corner or abutting right angle T-shaped relationship, said connector comprising:

(a) an elongate rectangular section having opposite major faces, opposite ends and opposite sides;

(b) an end flange projecting downwardly from one of said major faces at one of said ends;

(c) two directly opposed side flanges projecting downwardly from said one major face at each of said sides, said side flanges being spaced apart from one another and from said end flange a predetermined distance which corresponds to a cross-sectional length of said framing members; and (d) means for fastening said connector to said two framing members when the end portion of one of said framing members is located in the spacing between said side flanges and when the other of said framing members is located in the spacing between said end flange and said side flanges.

2. The connector as claimed in claim 1, further including two panel receiving means each projecting upwardly from the other of said opposite major faces and arranged at a right angle one to the other for respectively receiving in right angle relationship portions of two rectangular panel sections when positioned therein.

3. The connector as claimed in claim 2, wherein each of said two panel receiving means comprises a pair of opposed and spaced apart panel receiving flanges and wherein the spacing between opposed panel receiving flanges is no less than the thickness of said rectangular panel sections.

4. The connector as claimed in claim 3, wherein the panel receiving flanges of one of said two panel receiving means extends in a direction parallel with said side flanges, and the panel receiving flanges of the other of said panel receiving means extends in a direction parallel with said end flange.

5. The corner connector as claimed in claim 4, wherein said means for fastening includes a plurality of fastener receiving holes located in at least one of said end flange, said side flanges and said elongate rectangular section.

6. The corner connector as claimed in claim 5, wherein said pair of panel receiving flanges each include grasping means for respectively grasping a corner portion of said panel sections when positioned therein.

7. The connector as claimed in claim 3 when formed from a metal.

8. The connector as claimed in claim 3 when formed from metal and wherein said two panel receiving means are formed separately from said elongate rectangular section, end flange and side flanges which are formed together as a unit.

9. The connector as claimed in claim 3, wherein said elongate rectangular section, said end flange and said side flanges are formed as a single unit and each of said two panel support means comprise a U-shaped channel sections.

10. The connector as claimed in claim 9, wherein the bottom of each U-shaped channel section is provided with fastener receiving holes which respectively align with fastener receiving holes extending through said major faces of said elongate rectangular section.

11. The connector as claimed in claim 10, wherein at least one sidewall of each U-shaped channel section is provided with grasping means for respectively grasping a corner portion of said panel sections when positioned therein.

12. A connector for joining together two elongate framing members that have the same rectangular cross-sectional dimensions in either abutting right angle corner or abutting right angle T-shaped relationship and for further receiving two rectangular panel sections in complimentary right angle relationship to that of said framing members, said connector comprising:

(a) an elongate rectangular section having opposite major faces, opposite ends and opposite sides;

(b) an end flange at one of said ends and which projects outwardly from one of said major faces;

(c) two directly opposed side flanges projecting outwardly from said one of said major faces, said side flanges being spaced apart from one another and from said end flange a distance which corresponds to a cross-sectional length of said elongate framing members;

(d) means for attaching said connector to said two elongate framing members when the end portion of one framing member is located in the spacing between said side flanges and when the other of said framing members is located in the spacing between said end flange and said side flanges;

(e) two panel receiving means each projecting outwardly from the other of said major faces and arranged at a right angle one to the other for respectively receiving in right angle relationship portions of said rectangular panel sections when positioned therein.

13. The connector as claimed in claim 12, wherein said two panel receiving means each comprises a pair of opposed and spaced apart panel receiving flanges and wherein the spacing between each said pair of panel receiving flanges is no less than the thickness of said rectangular panel sections.

14. The connector as claimed in claim 13, wherein said two panel receiving means each comprises a U-shaped channel section and wherein one of said U-shaped section is disposed above and between said end flange and said side flanges and extends in a direction parallel to said end flange.

15. The connector as claimed in claim 14, wherein the other of said U-shaped section is disposed above and between said side flanges and extends in a direction parallel to said side flanges.

16. The connector as claimed in claim 15, wherein said elongate rectangular section, said end flange and said side flanges are formed as a single unit and each said U-shaped channel sections are formed as a separate unit and said attachment means including corresponding fastener receiving holes which extend through the bottom of each said channel section and through the major faces of said elongate rectangular section.

17. The connector as claimed in claim 15, wherein at least one sidewall of each said U-shaped channel section includes means for grasping a corner portion of said panel section when positioned therein.

* * * * *